US012378738B2

(12) United States Patent
Zhao et al.

(10) Patent No.: US 12,378,738 B2
(45) Date of Patent: Aug. 5, 2025

(54) ANTI-COLLISION BARRIER GATE ARM

(71) Applicant: Shenzhen Wins Electronic Technology Co., Ltd., Shenzhen (CN)

(72) Inventors: Shengfei Zhao, Shenzhen (CN); Pingcheng Guo, Shenzhen (CN)

(73) Assignee: Shenzhen Wins Electronic Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/764,280

(22) Filed: Jul. 4, 2024

(65) Prior Publication Data

US 2025/0012025 A1 Jan. 9, 2025

(30) Foreign Application Priority Data

Jul. 6, 2023 (CN) ..... 202321771999.0

(51) Int. Cl.
*E01F 13/06* (2006.01)

(52) U.S. Cl.
CPC ..... *E01F 13/06* (2013.01)

(58) Field of Classification Search
CPC ..... E01F 13/06; E06B 11/027
See application file for complete search history.

(56) References Cited

U.S. PATENT DOCUMENTS 10,006,246 B2 * 6/2018 Barwick ..... E06B 11/085
2021/0293089 A1 * 9/2021 Shebib Loiselle .... E06B 11/022
2024/0344282 A1 * 10/2024 Burnet ..... E01F 13/028

* cited by examiner

*Primary Examiner* — Daniel J Troy
*Assistant Examiner* — Susan M. Heschel
(74) *Attorney, Agent, or Firm* — Birchwood IP

(57) ABSTRACT

The present disclosure provides an anti-collision barrier gate arm including an arm, an arm holder, and a switching head configured to repeatedly switch between a separation state and a reset state, where the arm is connected to the arm holder through the switching head. The present disclosure has the beneficial effects that: an anti-collision barrier gate arm is provided; the switching head is additionally arranged between the arm and the arm holder; when the arm is subjected to a collision, the switching head can enter a separation state to provide a movement space for the arm so as avoiding damaging to the arm; and the switching head can quickly switch to a reset state, such that the arm can work normally again, helping to guarantee normal access of a parking lot.

19 Claims, 11 Drawing Sheets

ANTI-COLLISION BARRIER GATE ARM

CROSS-REFERENCE TO RELATED APPLICATIONS

This application claims priority to Chinese Patent Application No. 202321771999.0, filed on Jul. 6, 2023, which is hereby incorporated by reference in its entirety.

TECHNICAL FIELD

The present disclosure relates to a barrier gate arm, and in particular, to an anti-collision barrier gate arm.

BACKGROUND

A barrier gate arm is usually used in match with a barrier gate in a parking lot, for controlling vehicle access. During practical use, a vehicle is likely to collide with the barrier gate arm, causing damage to the barrier gate arm. As a result, a long time is required for maintenance, affecting normal access of the parking lot.

Therefore, how to provide an anti-collision barrier gate arm that is unlikely to be damaged even the barrier gate arm collides with a vehicle to well maintain normal access of the parking lot is an urgent technical problem to be solved by those skilled in the art.

SUMMARY

To solve the problems in the prior art, the present disclosure provides an anti-collision barrier gate arm that can prevent damage to a gate arm after the arm is subjected to a collision.

The present disclosure provides an anti-collision barrier gate arm including an arm, an arm holder, and a switching head configured to repeatedly switch between a separation state and a reset state, where the arm is connected to the arm holder through the switching head.

As a further improvement of the present disclosure, the switching head includes a first part and a second part. When the switching head is in the reset state, the first part is connected to the second part; and when the switching head is in the separation state, the first part is separated from the second part.

As a further improvement of the present disclosure, the first part is rotationally connected to the arm holder.

As a further improvement of the present disclosure, the first part is fixedly connected to the arm, and the second part is fixedly connected to the arm holder.

As a further improvement of the present disclosure, the first part includes a first base; the first base is fixedly connected to the arm; the second part includes a second base; the second base is fixedly connected to the arm holder; and the first base and the second base are snap-fitted.

As a further improvement of the present disclosure, the second base is provided with a clamping slot, and the first base is provided with an insert, and the insert is clamped into the clamping slot.

As a further improvement of the present disclosure, the clamping slot is arc-shaped, and the insert is arc-shaped.

As a further improvement of the present disclosure, the clamping slot is C-shaped, and the insert is elliptical.

As a further improvement of the present disclosure, the second base is made of deformable material.

As a further improvement of the present disclosure, the second base is made of plastic.

As a further improvement of the present disclosure, the first base is made of metal.

As a further improvement of the present disclosure, the arm holder is made of metal.

As a further improvement of the present disclosure, the first base is rotationally connected to the arm holder.

As a further improvement of the present disclosure, the first base is rotationally connected to the arm holder through a rotating shaft.

As a further improvement of the present disclosure, the rotating shaft includes a bolt and a nut, and the bolt is connected to the nut after passing through a rotating hole in the arm holder and a rotating hole in the first base.

As a further improvement of the present disclosure, the rotating shaft includes an anti-wear gasket, and the anti-wear gasket is installed between the first base and the arm holder for separating them.

As a further improvement of the present disclosure, the arm holder is provided with a cutoff slot for increasing a deformation space for the arm holder.

As a further improvement of the present disclosure, the arm holder includes a base plate and side plates located on two sides of the base plate, and the side plates are each provided with a cutoff slot.

As a further improvement of the present disclosure, the base plate and side plates enclose an installing groove, and the second base is installed in the installing groove.

As a further improvement of the present disclosure, the cutoff slot divides the arm holder into a front part and a rear part in a length direction, the second base is fixed to the front part, and the first base is rotationally connected to the rear part.

As a further improvement of the present disclosure, the first part further includes an upper clamping plate, the first base is provided with a lower clamping plate, and the arm is clamped between the upper clamping plate and the lower clamping plate.

As a further improvement of the present disclosure, the upper clamping plate and the lower clamping plate are arc-shaped; shapes of the upper clamping plate and lower clamping plate can fit with each other according to the shape of the arm. Preferably, arc-shaped components are used, but not limited to arc shape, as long as the arm can be clamped between the upper clamping plate and the lower clamping plate.

As a further improvement of the present disclosure, the upper clamping plate, the arm, and the lower clamping plate are fixedly connected through at least a bolt and a nut.

As a further improvement of the present disclosure, the arm holder is provided with an angle limiting structure that limits the rotation angle of the first base.

As a further improvement of the present disclosure, the angle limiting structure is a baffle, and when the first base rotates to a set angle around the arm holder, the first base stops rotating.

As a further improvement of the present disclosure, the arm is made up of two or more sub arms spliced together.

As a further improvement of the present disclosure, the arc-shaped insert is preferably elliptical, but not limited to an elliptical shape, and the shape of the arc-shaped insert can fit with that of the arc-shaped clamping slot, as long as the arc-shaped insert can be clamped into the arc-shaped clamping slot.

As a further improvement of the present disclosure, the switching head includes a first part and a second part; when the switching head is in the reset state, the first part is connected to the second part; when the switching head is in the separation state, the first part is separated from the second part; the first part is rotationally connected to the arm holder; the first part is fixedly connected to the arm; the second part is fixedly connected to the arm holder; the first part includes a first base; the first base is fixedly connected to the arm; the second part includes a second base; the second base is fixedly connected to the arm holder; the first base and the second base are snap-fitted; the second base is provided with a clamping slot; the first base is provided with an insert; the insert is clamped into the clamping slot; the clamping slot is arc-shaped; the insert is arc-shaped; the clamping slot is C-shaped; the insert is elliptical; the second base is made of deformable material; the second base is made of plastic; the first base is made of metal; the arm holder is made of metal; the first base is rotationally connected to the arm holder; the first base is rotationally connected to the arm holder through a rotating shaft; the rotating shaft includes a bolt and a nut; the bolt is connected to the nut after passing through a rotating hole in the arm holder and a rotating hole in the first base; the arm holder is provided with a cutoff slot for increasing a deformation space for the arm holder; the arm holder includes a base plate and side plates located on two sides of the base plate; the side plates are each provided with a cutoff slot; the base plate and side plates enclose an installing groove; the second base is installed in the installing groove; the cutoff slot divides the arm holder into a front part and a rear part in a length direction; the second base is fixed to the front part; the first base is rotationally connected to the rear part; the first part further includes an upper clamping plate; the first base is provided with a lower clamping plate; the arm is clamped between the upper clamping plate and the lower clamping plate; the upper clamping plate and the lower clamping plate are arc-shaped; the upper clamping plate, the arm, and the lower clamping plate are fixedly connected through at least a bolt and a nut; the arm holder is provided with an angle limiting structure that limits the rotation angle of the first base; the angle limiting structure is a baffle; when the first base is rotated to a set angle around the arm holder, the first base stops rotating; and the arm is made up of two or more sub arms spliced together.

The present disclosure has the beneficial effects that: according to the above solution, an anti-collision barrier gate arm is provided, where the switching head is additionally arranged between the arm and the arm holder; when the arm is subjected to a collision, the switching head can enter a separation state to provide a movement space for the arm so as avoiding damaging to the arm; and the switching head can quickly switch to a reset state, such that the arm can work normally again, helping to guarantee normal access of a parking lot.

BRIEF DESCRIPTION OF DRAWINGS

To describe the technical solution in embodiments of the present disclosure more clearly, the following briefly describes the accompanying drawings required for describing the embodiments. Apparently, the accompanying drawings in the following description show merely some embodiments of the present disclosure, and those of ordinary skill in the art may still derive other solutions based on these accompanying drawings without creative efforts.

DETAILED DESCRIPTION OF THE EMBODIMENTS

Figure 1:
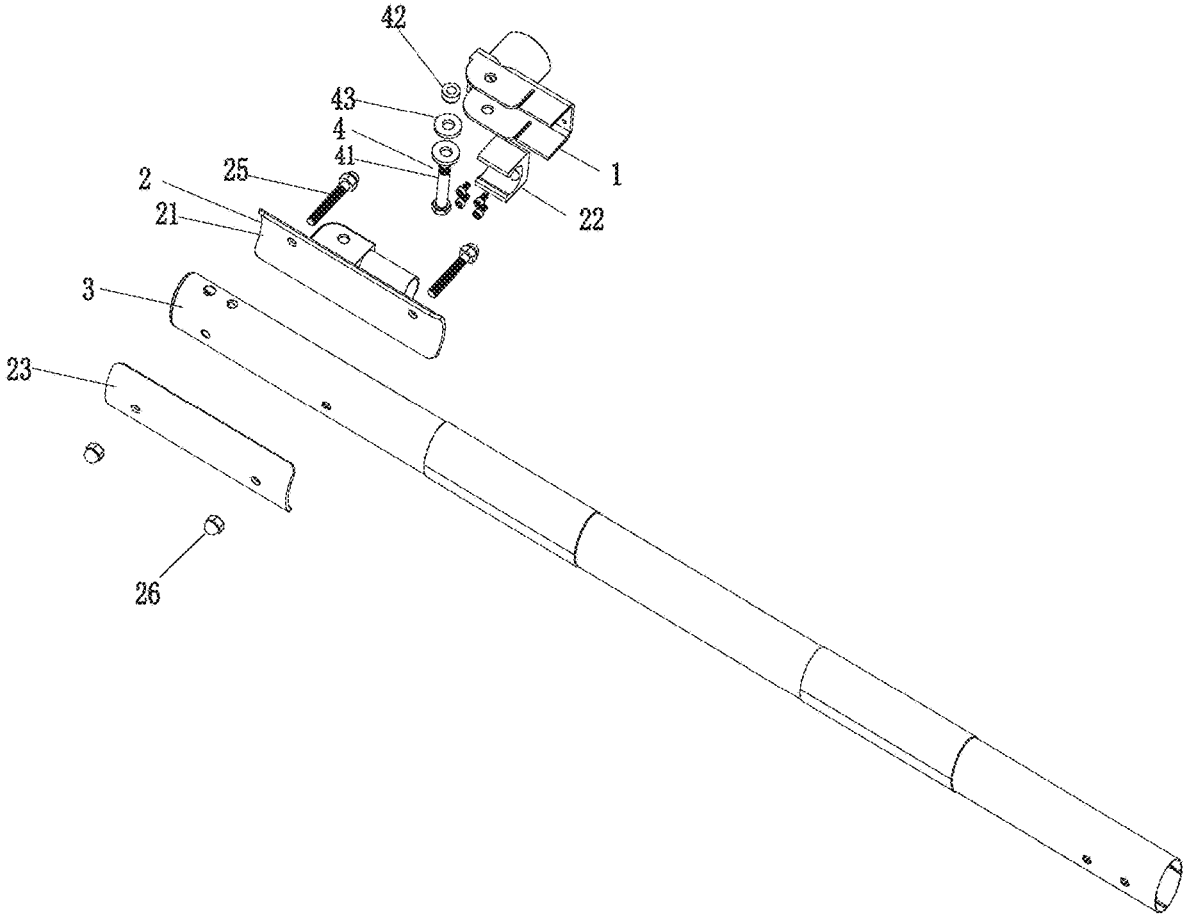
FIG. 1 is a schematic exploded view of an anti-collision barrier gate arm of the present disclosure.
Figure 2:
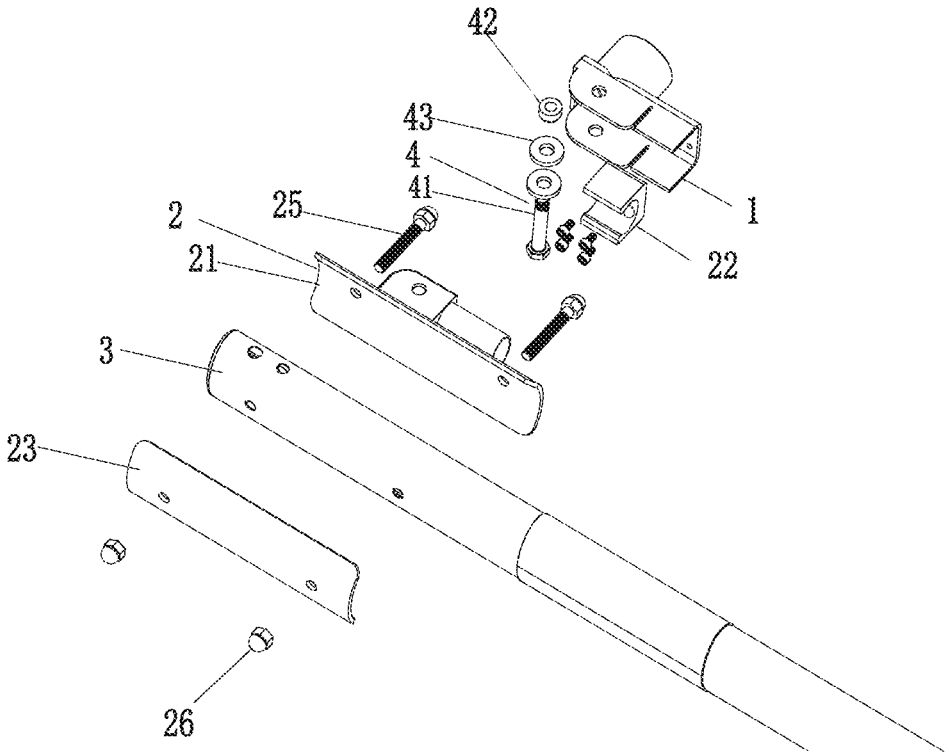
FIG. 2 is a partial schematic diagram of an anti-collision barrier gate arm of the present disclosure in an exploded state.
Figure 3:
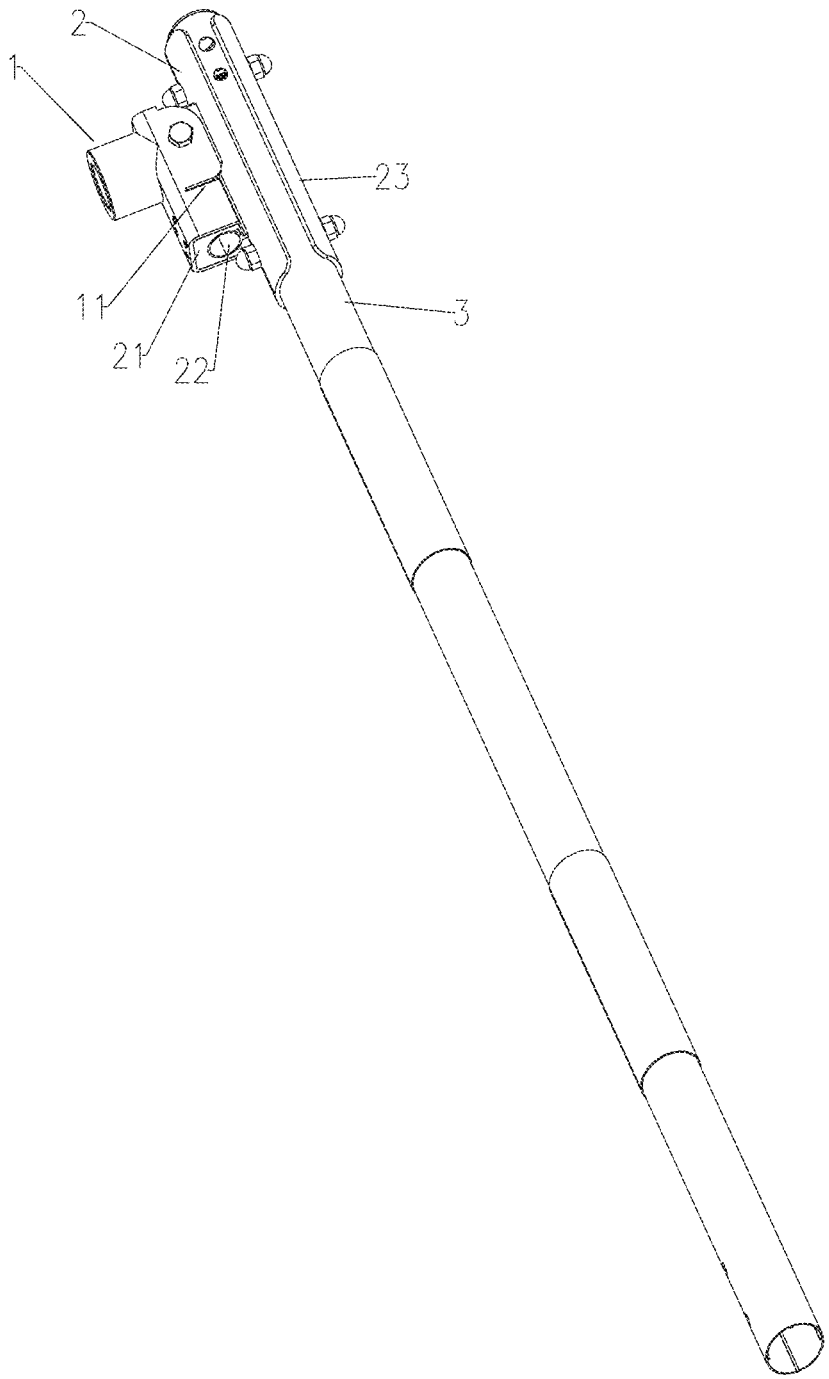
FIG. 3 is a schematic assembly diagram of an anti-collision barrier gate arm of the present disclosure.
Figure 4:
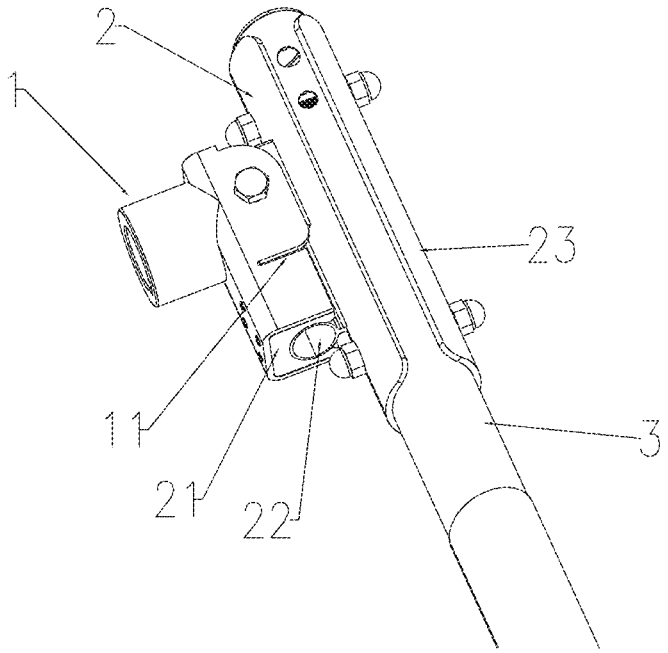
FIG. 4 is a partial schematic diagram of an anti-collision barrier gate arm of the present disclosure in an assembled state.

It should be noted that, without conflict, embodiments and features in the embodiments in the present disclosure can be combined with each other.

In the description of the present disclosure, the orientations or positional relationships indicated by the terms "center", "longitudinal", "transverse", "upper", "lower", "front", "rear", "left", "right", "vertical", "horizontal", "top", "bottom", "inside", "outside", and the like are based on the orientations or positional relationships as shown in the accompanying drawings. These terms are merely for ease and brevity of description of the embodiments of the present disclosure rather than for indicating or implying that the apparatuses or components mentioned must have specific orientations or must be constructed or manipulated according to specific orientations, and therefore shall not be construed as a limitation on the protection scope of the present disclosure. In addition, the terms "first", "second", and the like are merely for the purpose of description and shall not be construed as any indication or implication of relative importance or any implicit indication of the number of technical features indicated. Therefore, a feature limited by "first", "second", and the like may explicitly or implicitly include one or more such features. In the description of the present disclosure, "a plurality of" means two or more than two unless otherwise stated.

In the description of the present disclosure, it should be noted that unless otherwise specified and defined explicitly, the terms "mounting", "connection", and "connected" should be understood in their general senses. For example, they may refer to a fixed connection, a detachable connection, or an integral connection, and may refer to a direct connection, an indirect connection via an intermediate medium, or an internal communication between two elements. Those of ordinary skill in the art can understand specific meanings of these terms in the present disclosure as appropriate to specific situations.

The following further describes the present disclosure with reference to the description of the accompanying drawings and specific embodiments.

Embodiment 1

As shown in FIG. 1 to FIG. 11, an anti-collision barrier gate arm includes an arm 3, an arm holder 1, and a switching head 2 configured to repeatedly switch between a separation state and a reset state, where the arm 3 is connected to the arm holder 1 through the switching head 2.

This embodiment provides an anti-collision barrier gate arm, where the switching head 2 is additionally arranged between the arm 3 and the arm holder 1; when the arm 3 is subjected to a collision, the switching head 2 can enter the separation state to provide a movement space for the arm 3 so as avoiding damaging to the arm 3; and the switching head 2 can quickly switch to the reset state, such that the arm 3 can work normally again, helping to guarantee normal access of a parking lot.

Embodiment 2

As shown in FIG. 1 to FIG. 11, the structure of the switching head 2 is further described on the basis of Embodiment 1.

The switching head 2 includes a first part and a second part. When the switching head 2 is in the reset state, the first part is connected to the second part; and when the switching head is in the separation state, the first part is separated from the second part.

The first part is rotationally connected to the arm holder 1.

The first part is fixedly connected to the arm 3, and the second part is fixedly connected to the arm holder 1.

In this embodiment, the switching head 2 is divided into two parts, respectively a first part and a second part. When the switching head 2 is in the reset state, the arm 3 can be kept in a normal working state. When the switching head 2 is in the separation state, the first part is separated from the second part to provide a movement space for the arm 3 so as avoiding damaging to the arm 3. In addition, the first part is rotationally connected to the arm holder 1, that is, when the switching head 2 is in the separation state, the arm 3 rotates relative to the arm holder 1, and a motion trail of the arm 3 can be well-controlled, preventing the arm 3 in a released state from hurting passersby or other devices, and also well-controlling the first part to be released from the constraint of the second part.

In this embodiment, the switching head 2 is divided into two parts. The first part is fixedly connected to the arm 3, the second part is fixedly connected to the arm holder 1, the switching head 2 has a function of repeatedly switching between the separation state and the reset state, and the arm is compatible to the existing gate arms and gate arm holders, without a need to change the structures of the existing gate arms and gate arm holders.

Embodiment 3

As shown in FIG. 1 to FIG. 11, the structure of the switching head 2 is further described on the basis of Embodiment 2.

The first part includes a first base 21; the first base 21 is fixedly connected to the arm 3; the second part includes a second base 22; the second base 22 is fixedly connected to the arm holder 1; and the first base 21 and the second base 22 are snap-fitted.

The second base 22 is provided with an arc-shaped clamping slot 221, the first base 21 is provided with an arc-shaped insert 211, and the arc-shaped insert 211 is clamped into the arc-shaped clamping slot 221.

In this embodiment, when the switching head 2 is in the reset state, that is, when the anti-collision barrier gate arm is in a normal working state, the arc-shaped insert 211 is clamped into the arc-shaped clamping slot 221, and the arm 3 works normally. Once the arm 3 is subjected to a collision, the arm 3 is rotationally opened to drive the arc-shaped insert 211 to be separated from the arc-shaped clamping slot 221. At that moment, the switching head 2 is in the separation state. Since the arm 3 is rotationally opened during the collision, hard damage can be avoided, and the arm can be quickly recovered to a normal state as long as the arm 3 is reset and the arc-shaped insert 211 is clamped into the arc-shaped clamping slot 221.

Embodiment 4

As shown in FIG. 1 to FIG. 11, the structure of the switching head 2 is further described on the basis of Embodiment 3.

To allow the arc-shaped insert 211 to be well clamped into the arc-shaped clamping slot 221 and to be released from the constraint of the arc-shaped clamping slot 221 under stress, the arc-shaped clamping slot is configured to be C-shaped, and the arc-shaped insert is configured to be elliptical.

In this embodiment, the elliptical insert 211 is clamped into the C-shaped clamping slot 221 and thus can be quickly separated and clamped, providing a structural support for repeated switching of the switching head 2 between the separation state and the reset state.

In this embodiment, the C-shaped clamping slot 221 fit with the elliptical insert 211 to provide a reliable clamping force, thereby avoiding a problem of separation when the arm is opened or closed.

Embodiment 5

As shown in FIG. 1 to FIG. 11, the structure of the switching head 2 is further described on the basis of Embodiment 3.

The second base 22 is made of deformable material such as plastic, which may be polytetrafluoroethylene.

The first base 21 is made of metal such as stainless steel. the arm holder 1 is made of metal such as stainless steel.

In this embodiment, materials of the arm holder 1, the first base 21, and the second base 22 are optimally designed, where the second base 22 is made of plastic such as polytetrafluoroethylene. This provides a basis for deformation of the second base and endows the second base with an abrasion resistance characteristic, realizing repeated separation and clamping, thus helping to prolong the service life of the anti-collision barrier gate arm. The first base 21 and the arm holder 1 are made of metal. This enhances the strength of the first base 21 and gate arm holder 1. In addition, the first base 21 made of metal and the second base 22 made of plastic fit with each other, with one being hard and the other one being soft, facilitating the snap fitting therebetween. Moreover, the arm holder 1 made of a sheet metal component also can provide a limited deformation space and high-strength constraint for deformation of the second base 22 made of plastic, preventing a failure of normal mounting of the arm 3 caused by a failure in clamping the first base 21 due to excessive deformation of the second base 22.

Embodiment 6

As shown in FIG. 1 to FIG. 11, the structure of the switching head 2 is further described on the basis of Embodiment 3.

The first base 21 is rotationally connected to the arm holder 1.

The first base 21 is rotationally connected to the arm holder 1 through a rotating shaft 4.

The rotating shaft 4 includes a bolt 41 and a nut 42, and the bolt 41 is connected to the nut 42 after passing through a rotating hole 15 in the arm holder 1 and a rotating hole 213 in the first base 21.

The rotating shaft 4 includes an anti-wear gasket 43, and the anti-wear gasket 43 is installed between the first base 21 and the arm holder 1 for separating them.

The anti-wear gasket 43 is preferably made of polytetrafluoroethylene.

In this embodiment, when the arm 3 is subjected to a collision, the first base 21 is separated from the second base 22, the first base 21 drives the arm 3 to rotate about the bolt 41, and a motion trail of the arm 3 can be well-controlled, preventing the arm 3 in a released state from hurting passersby or other devices, and also well-controlling the first base 21 to be released from the constraint of the second base 22.

In this embodiment, the anti-wear gasket 43 is additionally arranged between the first base 21 and the arm holder 1, preventing abrasion between the first base 21 and the arm holder 1.

Embodiment 7

As shown in FIG. 1 to FIG. 11, the structure of the arm holder 1 is improved on the basis of Embodiment 3.

the arm holder 1 is provided with a cutoff slot 11 for increasing a deformation space for the arm holder.

Figure 5:
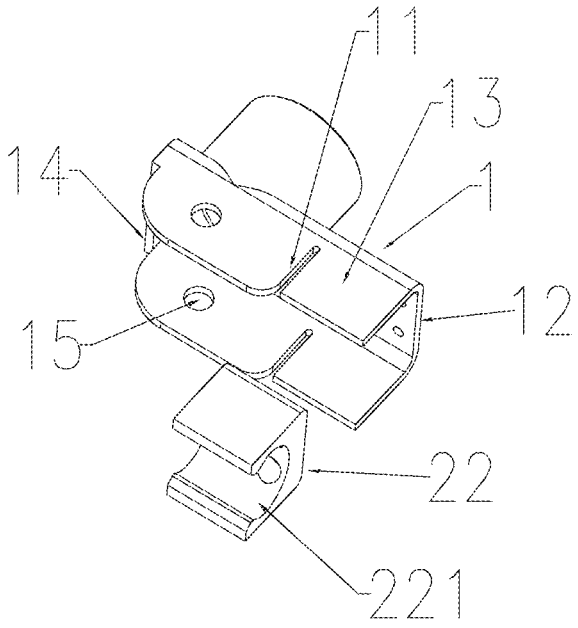
FIG. 5 is a schematic diagram of an arm holder and a second base of an anti-collision barrier gate arm of the present disclosure.
Figure 6:
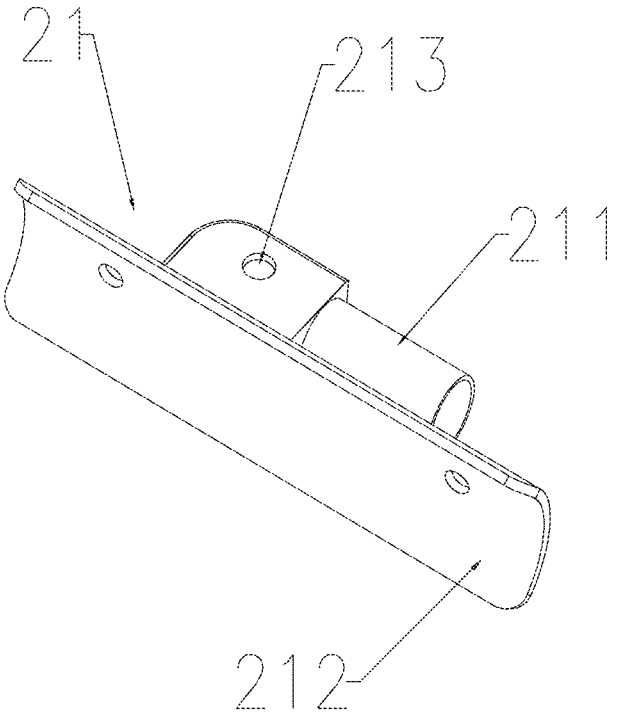
FIG. 6 is a schematic diagram of a first base of an anti-collision barrier gate arm of the present disclosure.
Figure 7:
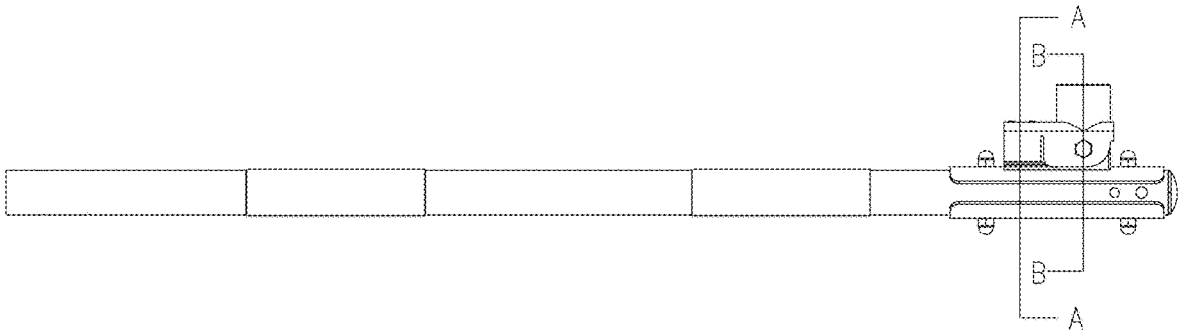
FIG. 7 is a front view of an anti-collision barrier gate arm of the present disclosure.
Figure 8:
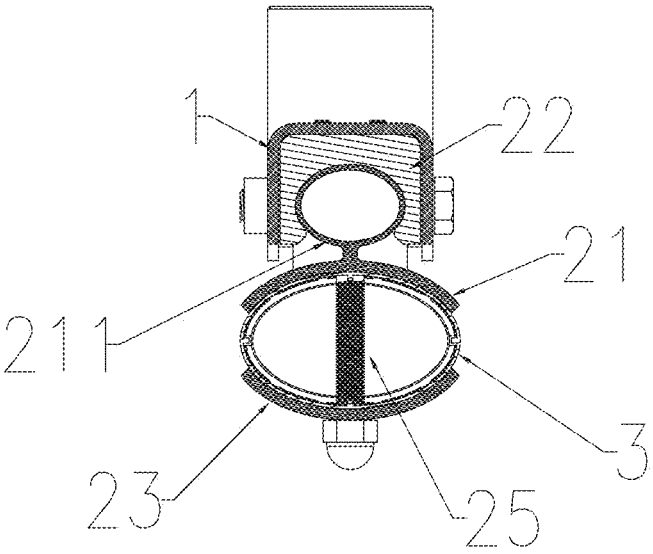
FIG. 8 is a cross-sectional view along A-A in FIG. 7.
Figure 9:
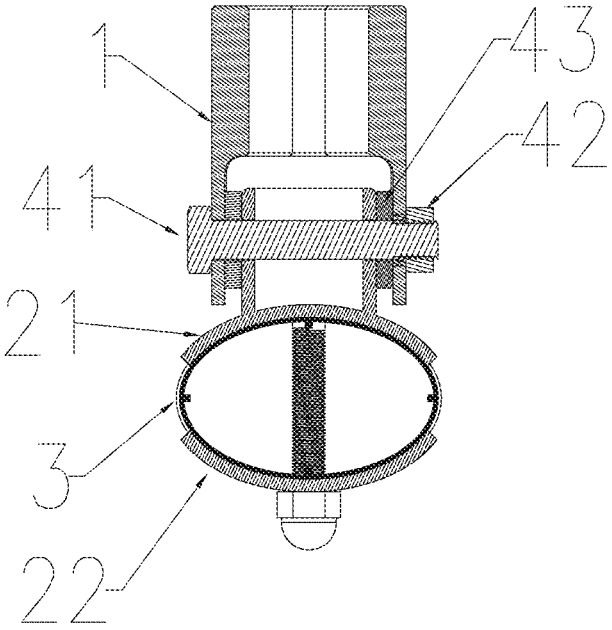
FIG. 9 is a cross-sectional view along B-B in FIG. 7.

In this embodiment, the second base 22 is mounted on the arm holder 1, the second base 22 requires a small deformation space, and the second base 22 can be provided with a small deformation space by forming a cutoff slot 11 on the arm holder 1. To be specific, the cutoff slot 11 divides the second base 22 into two parts, where one part (such as a left part as shown in FIG. 5) cannot stretch after locked by the bolt 41 and the nut 42, and the other part (such as a right part as shown in FIG. 5) can stretch to form a deformation space.

the arm holder 1 includes a base plate 12 and side plates 13 located on two sides of the base plate, and the side plates 13 are each provided with a cutoff slot 11.

The base plate 12 and side plates 13 enclose an installing groove, and the second base 22 is installed in the installing groove.

The cutoff slot 11 divides the arm holder 1 into a front part and a rear part in a length direction, the second base 22 is fixed to the front part, and the first base 21 is rotationally connected to the rear part.

In this embodiment, the side plates 13 of the arm holder 1 limit outward deformation of the second base 22, but the cutoff slot 11 provides a small space for the outward deformation of the second base 22.

Embodiment 8

As shown in FIG. 1 to FIG. 11, the structure of the switching head 2 is further described on the basis of Embodiment 3.

The first part further includes an upper clamping plate 23, the first base 21 is provided with a lower clamping plate 212, and the arm 3 is clamped between the upper clamping plate 23 and the lower clamping plate 212.

The upper clamping plate 23 and the lower clamping plate 212 are arc-shaped.

The upper clamping plate 23, the arm 3, and the lower clamping plate 212 are fixedly connected through a bolt 25 and a nut 26.

In this embodiment, without changing the original gate arm, the arm 3 is clamped by the upper clamping plate 23 and the lower clamping plate 212 and locked by the bolt 25 and the nut 26, lowering the modification cost and also realizing convenient assembly, simple dismounting and simple mounting.

In some embodiments, a special upper clamping plate or lower clamping plate can be omitted. In some embodiments, special upper clamping plate and lower clamping plate can both be omitted, and the arm is directly connected to the first base 21 through a connector.

Embodiment 9

As shown in FIG. 1 to FIG. 11, an opening angle of the arm 3 is limited on the basis of Embodiment 3.

the arm holder 1 is provided with an angle limiting structure 14 that limits the rotation angle of the first base 21.

Figure 10:
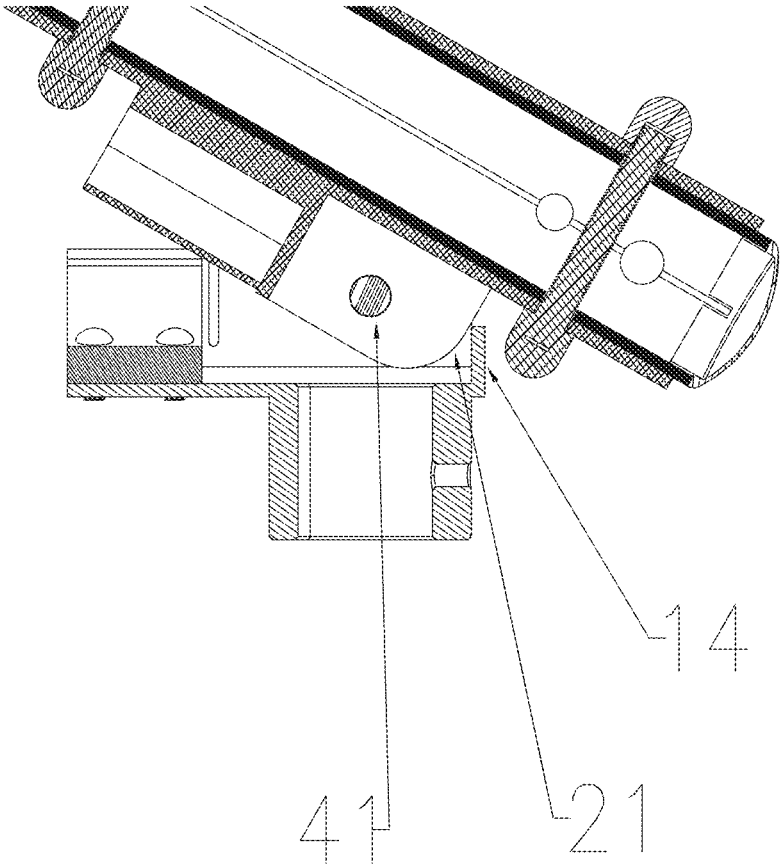
FIG. 10 is a schematic diagram of an anti-collision barrier gate arm rotating in place of the present disclosure.

As shown in FIG. 10, the angle limiting structure 14 is a baffle, and when the first base 21 rotates to a set angle around the arm holder 1, rotational opening of the first base 21 is limited by obstruction of the baffle.

In this embodiment, after the arm 3 is subjected to a collision, the first base 21 is released, the arm 3 is rotationally opened upwards, and the first base 21 rotationally stretches around the arm holder 1. To prevent the arm 3 from being opened excessively, the angle limiting structure 14 is used to limit the arm 3 within a set angle range. For example, the opening angle of the arm 3 may be limited to 30 degrees, 40 degrees, or the like, facilitating safety improvement and preventing the arm 3 in a released state from hurting passersby or other devices.

Embodiment 10

As shown in FIG. 1 to FIG. 11, the structure of the arm 3 is improved on the basis of Embodiment 1.

the arm 3 is made up of two or more sub arms spliced together.

Figure 11:
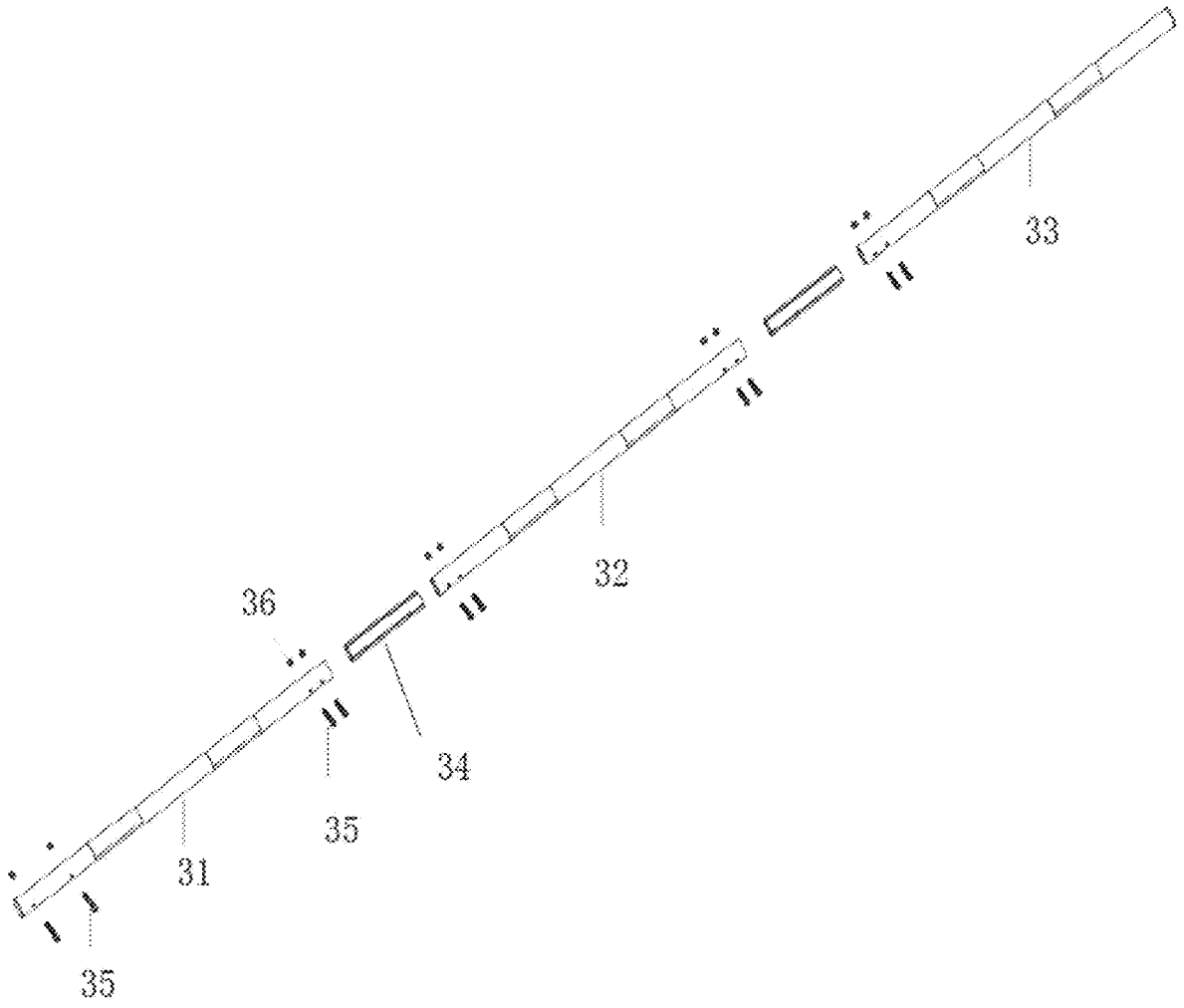
FIG. 11 is a schematic splicing diagram of an arm of an anti-collision barrier gate arm of the present disclosure.

As shown in FIG. 11, the arm 3 may be divided into three segments, which are respectively a sub arm 31, a sub arm 32, and a sub arm 33. The three sub arms are connected as a whole by two segments of connecting pipes 34 in cooperation with a bolt 35 and a nut 36.

In this embodiment, a segmental splicing design is used. During transportation, the arm 3 can be disassembled into a plurality of segments to facilitate packaging and transportation, and splicing is performed during mounting. In an actual application scenario, with use of a disassembly and assembly method, an arm with a total length of 3.9 m can be disassembled into 3 segments to facilitate transportation. During mounting, only a bolt 35 and a nut 36 are required for fixation and assembly.

The foregoing content is a further detailed description of the present disclosure in conjunction with specific preferred embodiments, but it should not be construed as that the specific implementations of the present disclosure are limited to these descriptions. It should be noted that for those of ordinary skill in the technical field to which the present disclosure belongs, several simple deductions or replacements can be further made without departing from the concept of the present disclosure, all of which shall be construed as falling within the protection scope of the present disclosure.

What is claimed is:

1. An anti-collision barrier gate arm, comprising an arm, an arm holder, and a switching head configured to repeatedly switch between a separation state and a reset state, wherein the arm is connected to the arm holder through the switching head;

the switching head comprises a first part and a second part;

when the switching head is in the reset state, the first part is connected to the second part;

when the switching head is in the separation state, the first part is separated from the second part;

the first part is rotationally connected to the arm holder;

the first part is fixedly connected to the arm;

the second part is fixedly connected to the arm holder;

the first part comprises a first base, the first base is fixedly connected to the arm;

the second part comprises a second base, the second base is fixedly connected to the arm holder; and the first base and the second base are snap-fitted;

the arm holder is provided with a cutoff slot for increasing a deformation space for the arm holder.

2. The anti-collision barrier gate arm according to claim 1, wherein the second base is provided with a clamping slot, the first base is provided with an insert, and the insert is clamped into the clamping slot.

3. The anti-collision barrier gate arm according to claim 2, wherein the clamping slot is arc-shaped, and the insert is arc-shaped.

4. The anti-collision barrier gate arm according to claim 2, wherein the clamping slot is C-shaped, and the insert is elliptical.

5. The anti-collision barrier gate arm according to claim 2, wherein the second base is made of deformable material.

6. The anti-collision barrier gate arm according to claim 2, wherein the second base is made of plastic.

7. The anti-collision barrier gate arm according to claim 2, wherein the first base is made of metal.

8. The anti-collision barrier gate arm according to claim 2, wherein the arm holder is made of metal.

9. The anti-collision barrier gate arm according to claim 1, wherein the first base is rotationally connected to the arm holder.

10. The anti-collision barrier gate arm according to claim 9, wherein the first base is rotationally connected to the arm holder through a rotating shaft.

11. The anti-collision barrier gate arm according to claim 10, wherein the rotating shaft comprises a bolt and a nut, and the bolt is connected to the nut after passing through a rotating hole in the arm holder and a rotating hole in the first base.

12. The anti-collision barrier gate arm according to claim 10, wherein the rotating shaft comprises an anti-wear gasket, and the anti-wear gasket is installed between the first base and the arm holder for separating them.

13. The anti-collision barrier gate arm according to claim 1, wherein the arm holder comprises a base plate and side plates located on two sides of the base plate, and the side plates are each provided with a cutoff slot, wherein the base plate and side plates enclose an installing groove, and the second base is installed in the installing groove.

14. The anti-collision barrier gate arm according to claim 1, wherein the cutoff slot divides the arm holder into a front part and a rear part in a length direction, the second base is fixed to the front part, and the first base is rotationally connected to the rear part.

15. The anti-collision barrier gate arm according to claim 1, wherein the first part comprises an upper clamping plate, the first base is provided with a lower clamping plate, and the arm is clamped between the upper clamping plate and the lower clamping plate.

16. The anti-collision barrier gate arm according to claim 15, wherein the upper clamping plate and the lower clamping plate are arc-shaped.

17. The anti-collision barrier gate arm according to claim 15, wherein the upper clamping plate, the arm, and the lower clamping plate are fixedly connected through a bolt and a nut.

18. The anti-collision barrier gate arm according to claim 1, wherein the arm holder is provided with an angle limiting structure that limits the rotation angle of the first base.

19. The anti-collision barrier gate arm according to claim 18, wherein the angle limiting structure is a baffle, and when the first base rotates to a set angle around the arm holder, the first base stops rotating.

* * * * *